US007045721B1

(12) United States Patent
Green et al.

(10) Patent No.: US 7,045,721 B1
(45) Date of Patent: May 16, 2006

(54) LIFTING DEVICE FOR USE WITH DRUM WEIGHING MACHINE

(75) Inventors: Donald H Green, Freeport, TX (US); Michael J Seiver, Houston, TX (US); Thomas P Reichelt, Katy, TX (US)

(73) Assignee: Specialty Equipment Coveyor Company, Houston, TX (US)

( * ) Notice: Subject to any disclaimer, the term of this patent is extended or adjusted under 35 U.S.C. 154(b) by 157 days.

(21) Appl. No.: 10/795,650

(22) Filed: Mar. 8, 2004

Related U.S. Application Data

(63) Continuation-in-part of application No. 10/408,911, filed on Apr. 9, 2003, now Pat. No. 6,725,890.

(51) Int. Cl.
*G01G 19/00* (2006.01)

(52) U.S. Cl. ..... 177/146; 141/83; 53/502

(58) Field of Classification Search ..... 177/145–146; 53/502; 141/83
See application file for complete search history.

(56) References Cited

U.S. PATENT DOCUMENTS

| | | | | |
|---|---|---|---|---|
| 2,771,288 | A | 11/1956 | Staples, Jr. et al. | 177/146 |
| 3,587,760 | A | 6/1971 | Linz | 177/141 |
| 3,736,997 | A | 6/1973 | Bottorf | 177/145 |
| 4,002,215 | A * | 1/1977 | Harvill | 177/146 |
| 4,018,026 | A * | 4/1977 | Kamisaka et al. | 53/471 |
| 4,337,802 | A * | 7/1982 | Kennedy et al. | 141/1 |
| 4,392,445 | A * | 7/1983 | Burg | 114/67 A |
| 4,403,680 | A | 9/1983 | Hillesheimer | 177/146 |
| 4,494,583 | A * | 1/1985 | Reeves et al. | 141/83 |
| 4,619,359 | A | 10/1986 | Kennedy, Jr. et al. | 198/463.5 |
| 4,630,654 | A * | 12/1986 | Kennedy, Jr. | 141/83 |
| 4,673,048 | A | 6/1987 | Curran | 177/146 |
| 4,696,357 | A | 9/1987 | Beehler et al. | 177/145 |
| 4,889,202 | A * | 12/1989 | Bron | 177/134 |
| 5,835,982 | A * | 11/1998 | Lanaro et al. | 177/145 |
| 6,119,475 | A * | 9/2000 | Murray et al. | 62/292 |
| 6,150,618 | A * | 11/2000 | Chou | 177/145 |
| 6,725,890 | B1 * | 4/2004 | Green et al. | 141/172 |
| 6,891,112 | B1 * | 5/2005 | Weber | 177/145 |

* cited by examiner

*Primary Examiner*—Randy W. Gibson
(74) *Attorney, Agent, or Firm*—Jones & Smith, LLP; E. Randall Smith

(57) ABSTRACT

Apparatus, system and methods useful for lifting a drum to enable the drum and its contents to be accurately weighed includes a drum weighing platform engageable with the drum, at least two guide rods. The guide rods are movable upwardly in unison to move the drum weighing platform vertically upwardly.

20 Claims, 5 Drawing Sheets

LIFTING DEVICE FOR USE WITH DRUM WEIGHING MACHINE

This application is a continuation-in-part application of prior U.S. patent application Ser. No. 10/408,911 now U.S. Pat. No. 6,675,890 filed Apr. 9, 2003 and entitled Apparatus and Method for Automatically Handling and Filling Drums.

BACKGROUND OF THE INVENTION

The invention relates generally to apparatus and methods for lifting one or more drum in connection with a drum weighing machine.

Various machines and systems involve the handling of drums, barrels or other types of containers (collectively "drums"). Some examples of such machines and systems are drum filling systems and drum processing systems. In connection with such machines and systems, it is often necessary or desirable to precisely weigh the drum to meet drum content requirements, regulatory compliance or any other reason.

Many drum handling machines and systems require the drum to be lifted off a base, conveyor system or other structure in order to be weighed. In such instances, if the drum is not precisely lifted, the measured weight of the drum may be inaccurate. For example, if the platform upon which the drum rests contacts or drags upon an adjacent structure or part of the system, the measured weight may be affected. For another example, if the drum is on a drum filling machine that includes a drum filling lance extended into the drum and is not lifted precisely (or nearly precisely) vertically, the lance may contact the drum during weighing, causing an inaccurate weight measurement.

In many applications, if the measured weight of the drum is inaccurate (even by a mere fraction), the economic, legal, health and welfare and/or other consequences could be severe. For example, in an operation involving the daily filling of a quantity of one-thousand (1,000 ea.) 55-gallon type drums with a chemical costing $25.00 per pound, an inaccurate weight measurement resulting in mistakenly overfilling each drum by one pound (1 lb) will cause an economic loss of $25,000 per day.

Accordingly, there exists a need for drum lifting apparatus and methods used in connection with the weighing of the drum(s) and having one or more of the following attributes, capabilities or features: precise movement in a vertical plane of a drum lifting platform with little or no movement thereof in any other plane; precise lifting of a drum and its contents weighing up to numerous hundreds of pounds; lifting a drum without movement of the drum from side-to-side or back and forth; preventing a drum lifting platform from dragging on adjacent structure; preventing twisting or rotation of a drum lifting platform during lifting and weighing of the drum; assisting in maintaining the desired positioning of a drum filling lance within the drum during lifting and weighing of the drum on a drum filling machine; assisting in maintaining the centering of a drum lifting platform on a drum handling machine.

BRIEF SUMMARY OF THE INVENTION

In various embodiments, the present invention involves a drum lifting apparatus useful in connection with a drum weighing device and being capable of lifting a drum to enable the drum and its contents to be accurately weighed by the drum weighing device. The drum lifting apparatus includes a drum weighing platform and at least two guide rods. The drum weighing platform is engageable with the drum and capable of supporting the drum. The guide rods are associated with the drum weighing platform and are movable upwardly in unison to move the drum weighing platform precisely upwardly. At least one upper stabilizer is rigidly engaged with the guide rods proximate to the upper end of each guide rod, and at least one lower stabilizer is rigidly engaged with the guide rods proximate to their lower ends. The upper and lower stabilizers assist in synchronizing the upward movement of the guide rods.

In some embodiments, the drum lifting apparatus includes at least four guide rods associated with the drum weighing platform and which are movable upwardly in unison to move the drum weighing platform precisely upwardly. A mounting plate is engaged between the guide rods and the drum weighing platform. The mounting plate assists in synchronizing the upward movement of the guide rods to provide precise upward movement of the drum weighing platform.

The present invention may be embodied in an apparatus for processing at least one drum. Included is a drum rotating device capable of rotating a drum around a vertical axis. The drum rotating device includes a pair of spaced idler wheels engageable with the outer surface of the drum, and a power-operated drive wheel engageable with the outer surface of the drum opposite the spaced idler wheels. The apparatus also includes a drum lifting apparatus capable of lifting a drum to enable the drum and its contents to be accurately weighed by a drum weighing device. The drum lifting apparatus includes a drum weighing platform and at least two guide rods. The guide rods are movable upwardly in unison to move the drum weighing platform precisely vertically upwardly.

Some embodiments of the invention involve an apparatus for processing at least one drum. These embodiments include a drum rotating platform upon which a drum may be held upright and rotated. A plurality of rollers is associated with the drum rotating platform, the axis of each of the rollers being oriented generally radially relative to the vertical axis of a drum disposed upon the drum rotating platform. Also included is a drum lifting apparatus capable of lifting a drum to enable the drum and its contents to be accurately weighed by a drum weighing device. The drum lifting apparatus includes a drum weighing platform and at least two guide rods. The guide rods are movable upwardly in unison to move the drum weighing platform precisely vertically upwardly.

The present invention also includes embodiments involving an apparatus for processing at least one drum, the drum having a bunghole formed in its top surface. Included is a drum rotating platform upon which a drum may be held upright and rotated. An electronic bunghole sensor is capable of sensing the bunghole when the drum is rotated upon the drum rotating platform. Also included is a drum lifting apparatus capable of lifting a drum to enable the drum and its contents to be accurately weighed by a drum weighing device. The drum lifting apparatus includes a drum weighing platform and at least two guide rods. The guide rods are movable upwardly in unison to move the drum weighing platform precisely vertically upwardly.

Accordingly, the present invention includes features and advantages which are believed to enable it to advance drum handling technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF PREFERRED EMBODIMENTS OF THE INVENTION

Figure 1:
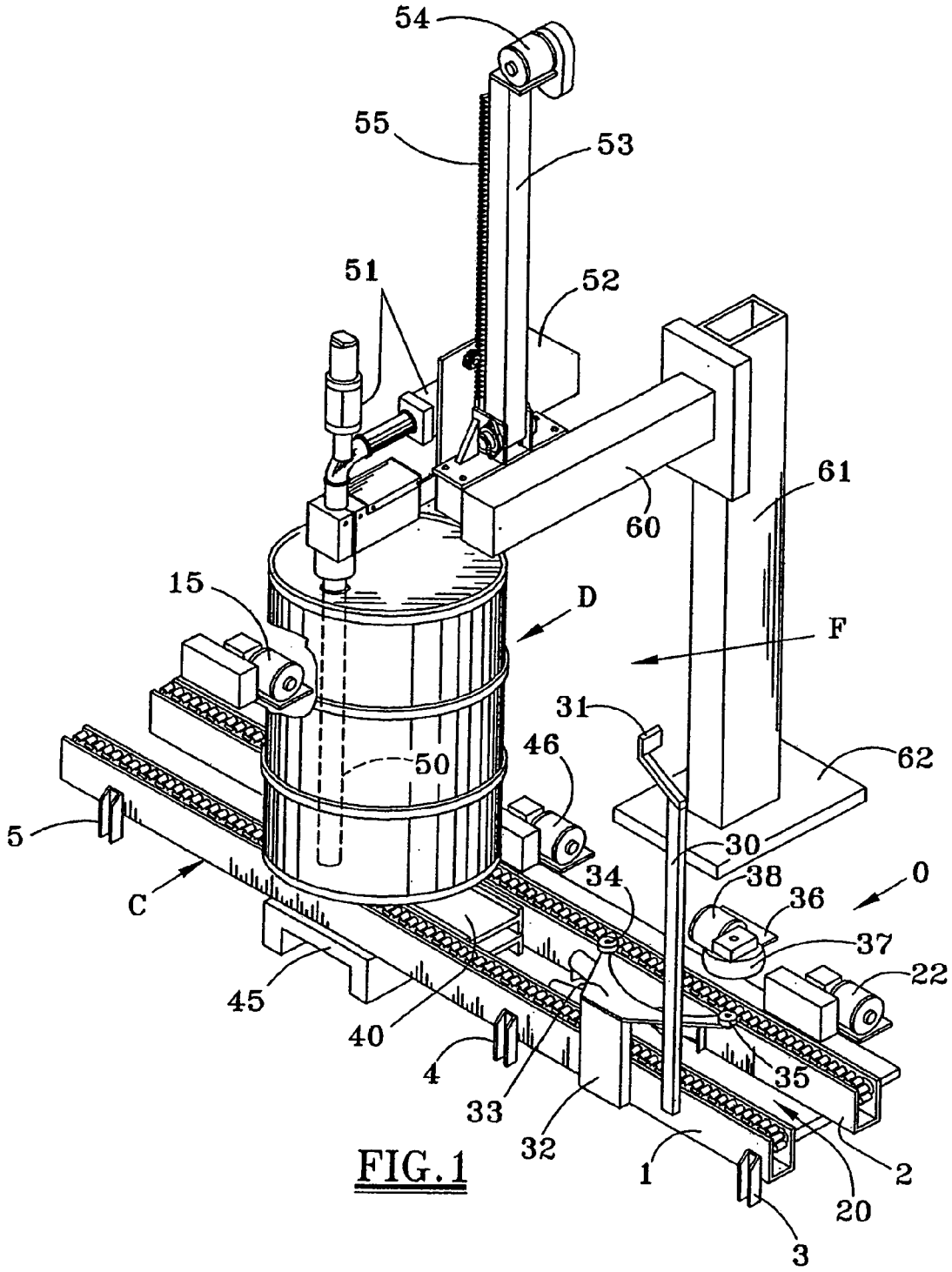
FIG. 1 is a perspective view of an example of an automatic drum handling and filling apparatus with which an embodiment of the present invention may be used.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents, and alternatives falling within the spirit and scope of the invention as defined by the appended claims. In showing and describing preferred embodiments, common or similar features are indicated by like or identical reference numerals or, in the absence of a reference numeral, are evident based upon the appended drawings and/or description herein. The figures are not necessarily to scale and certain features and certain views of the figures may be shown exaggerated in scale or in schematic in the interest of clarity and conciseness.

As used in this patent (including the headings), the terms "invention", "present invention" and variations thereof are not intended to mean the invention of every possible embodiment of the invention or any particular patent claim or claims. Thus, the subject or topic of each such reference is not necessarily part of or required by any particular claim(s) merely because of such reference.

Figure 2:
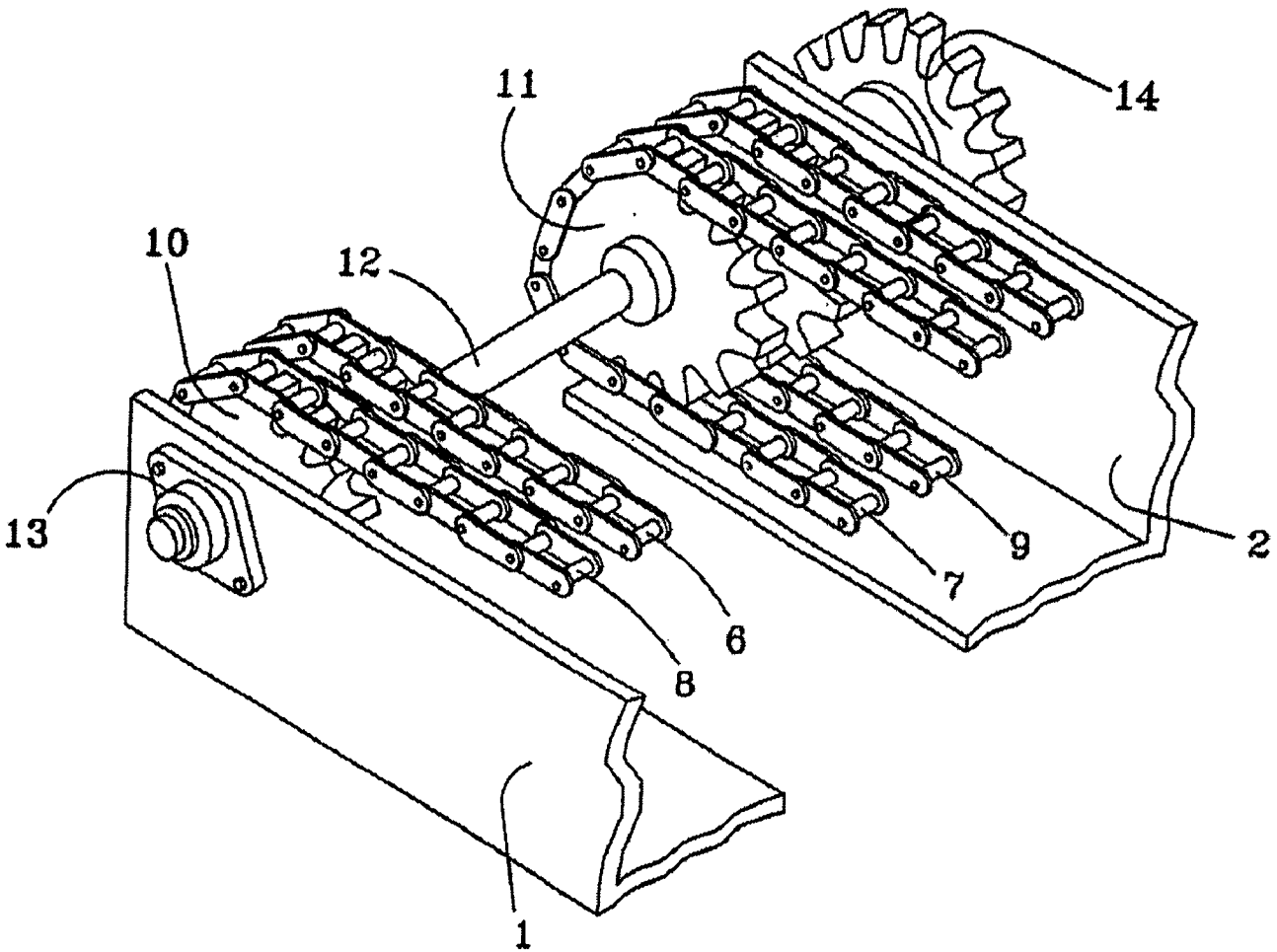
FIG. 2 is a perspective view a portion of an example drum conveyor apparatus useful with the automatic drum handling and filling apparatus shown in FIG. 1.
Figure 3:
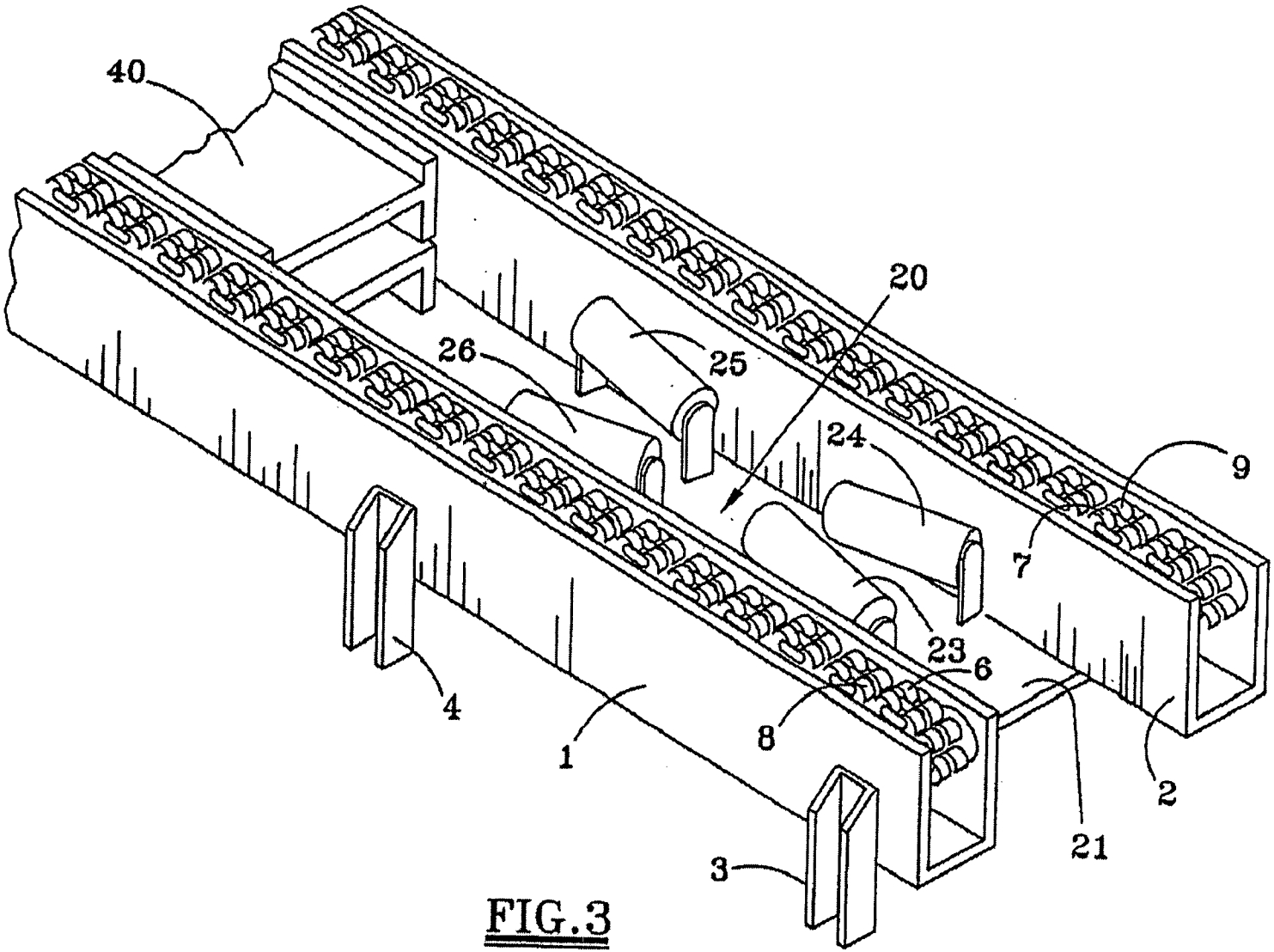
FIG. 3 is a perspective view of an example drum rotating platform useful with the automatic drum handling and filling apparatus shown in FIG. 1.

Referring to FIGS. 1–3, an example drum processing apparatus or system will be described. It should be understood, however, that the present invention is not limited to use with the following system or any details of such system as described below or shown in FIGS. 1–3. Referring initially to FIG. 1, there is shown an example apparatus designed for automatically handling and filling drums, the upper ends of which are provided with openings or "bungholes" for the filling thereof. The bungholes may be closed by closure members or "bungs".

The drums, such as drum D, are moved by a conveyor system, a portion of which is generally indicated at C, from one location to another. For example, the drums may be moved to conveyor system portion C from a storage or accumulation location (not shown). At conveyor system portion C, the drums go to an orienting station O and a filling station F. Then, the drums can be moved on, such as to a capping and sealing station (not shown).

In the embodiment of FIG. 1, the illustrated portion C of the conveyor system includes a pair of spaced apart, upwardly opening elongated channel members 1 and 2 (see also FIG. 3) horizontally supported on a plurality of support legs 3, 4, 5 etc. Disposed within the channel members 1 and 2, as shown in FIG. 3, are two pairs of parallel chains. In this example, a first pair of chains 6 and 7 is shown spaced apart to engage the lower end of drum D on opposite sides of the vertical center thereof. A second pair of chains 8, 9 is spaced apart to also engage the lower end of drum D on opposite sides of the vertical center thereof, but further from the center than the first pair 6 and 7.

Referring to FIG. 2, each of the chains 6, 7, 8 and 9 of this embodiment engages corresponding sprockets 10 and 11 at opposite ends of the channel members 1 and 2. The sprockets are mounted on corresponding shafts 12, the ends of which are supported by bearings 13, and one end of which is provided with a drive sprocket 14. The drive sprocket 14 may be engaged by another chain (not shown), which engages a drive motor 15 (FIG. 1) for rotating the sprockets 10, 11 and the shaft 12, and driving the chains 6, 7 and 8, 9.

Referring back to FIG. 1, as a drum, such as drum D, moves onto the illustrated portion C of the conveyor system, it first moves to an orienting station O for proper orientation of the bunghole thereof. Extending upwardly from one of the channel members is a vertical support member 30, at the upper end of which is provided an electronic bung sensing device 31. Also extending upwardly from one of the channel members is a support arm 32 and support plate 33 at opposite ends of which are provided idler wheels 34 and 35. The idler wheels 34, 35 are engageable with outer surfaces of a drum located at the orienting station.

Extending inwardly from a vertical support (not shown) attached to one of the channel members is a plate 36 on which is supported for rotation about a vertical axis a drive wheel 37. A power device 38 for rotating the drive wheel 37 may also be included. The support arm 32 and the support on which plate 36 is supported are moveable from widely spaced apart positions that allow free movement of a drum along the conveyor system C, to more inwardly spaced positions in which the idler wheels 34, 35 and the drive wheel 37 engages opposing outer surfaces of a drum located at the orienting station O.

The orienting station O also includes a lifting apparatus 20 which is operable to lift a drum off of the conveyor chains. The example lifting apparatus 20 shown in FIG. 3 includes a plate, or inverted channel member 21. Below the plate 21 is a lift (not shown) for raising and lowering the plate 21 between the channel members 1, 2. A pneumatic or hydraulic motor and pump 22 (FIG. 1), or any other suitable source, may provide the necessary power therefore. Mounted on the lifting plate 21 are a plurality of rollers, such as rollers 23, 24, 25 and 26. The rollers are mounted on axes which are substantially horizontal, each axis of which is radially disposed relative to the vertical axis of a drum which may rest thereabove. In the lowered position (as shown in FIG. 3), the rollers are below the chines at the lower end of any drum located on the conveyor chains 6, 7, 8, 9. However, when the lifting apparatus 20 is activated, raising the plate 21, the rollers 23, 24, 25, 26 engage the drum chines to lift the drum off of the conveyor chains 6, 7, 8, 9.

By actuating the lifting assembly 20 of this embodiment, a drum at the orienting station O may be lifted, resting only on the rollers 23, 24, 25 and 26. Referring again to FIG. 1, with the idler wheels 34 and 35 and the drive wheel 37 in an inwardly spaced position engaging the outer surface(s) of a drum located thereat, the power device 38 and drive wheel 37 may be actuated to rotate a drum at the orienting station to a particular position indicated by electronic sensing of the drum's bunghole by the electronic bunghole sensor 31. As soon as the bunghole is sensed at the proper location, rotation of the drive wheel 37 may be terminated and the idler wheels 34, 35 and the drive wheel 37 moved to outer positions to disengage the drum D. The lifting apparatus 20 may then be lowered so that the lower end of the drum at the orienting station O again engages the conveyor chains, allowing the drum, with the bunghole thereof properly oriented, to be moved, such as to the filling station F.

Still referring to FIG. 1, at the filling station F of this embodiment, the drum D is moved directly above a second lifting apparatus which includes an elongated channel plate or platform 40. The upper surfaces of the plate 40 normally lie below the upper moving surfaces of the conveyor chains. However, the lifting plate 40 is surmounted on a lift mechanism (not shown) powered by a power device 46 by which the plate 40 may be raised to engage the lower end of drum D, lifting it off of the conveyor chains. The lifting apparatus 40 is associated with a weighing device 45 by which the weight of the drum D and any liquid contents (after filling thereof) may be determined when the drum D is lifted off of the conveyor by the second lifting apparatus.

Also at the filling station F, a vertically disposed tubular filling lance 50, which is operatively connected through a hose or the like to a source of liquid (not shown), is provided. The lance 50 and valve assembly 51 (by which flow between the supply hose and the lance 50 is controlled) are attached in this example to a lance carriage 52 mounted on a vertical mast 53 for vertical up and down movement thereon. The vertical mast 53 is attached to and supported on the arm 60 of a support stanchion 61 affixed to a base 62. A power device 54 is attached to the mast and is operatively connected by a chain drive 55 to the lance carriage 52 for the up and down movement thereof. Since the lance 50 is supported by the lance carriage, the power device 54 is therefore effective in moving the lance 50 between raised positions above the drum D and lowered positions, when coaxially aligned with the drum bunghole, to extend through the bunghole into the drum D for filling it with liquid. Any suitable design for the construction of such vertically movably filling lances may be used. An example is shown in U.S. Pat. No. 6,053,219, which is hereby incorporated by reference herein in its entirety.

Thus, in the illustrated embodiment, the drum D may be moved from the orienting station O, with its bunghole properly aligned to the filling station F where it may be lifted and weighed and where the lance 50 may be lowered into the bunghole. As the drum D is filled with liquid, its weight is monitored and when it filled as desired, flow may be terminated and the lance 50 raised. The filled drum D may then be lowered onto the chains of the conveyor system C, such as for movement to a capping and sealing station where a bung may be placed in the bunghole and sealed.

The example apparatus and method described above provides for automatic movement of drums along a conveyor to an orienting station where the drum is lifted and rotated to a pre-selected position by electronically sensing the location of its bunghole. The drum is then lowered and moved to a filling station where the drum is lifted, weighed and a filling lance is lowered into the drum for filling thereof. The contents are weighed and filling is automatically terminated when the proper weight is reached. The lance is then raised, the filled drum lowered onto the conveyor and moved, such as to a capping and, sealing station and thereafter to a place for transport and/or storage, if desired.

The present invention will now be described. The present invention includes a drum lifting device having synchronized guide rods capable of moving a drum weighing platform precisely, or nearly precisely, vertically upwardly. In this patent, the term "precisely" (as used in the context of the upward or vertical movement of the guide rods, drum weighing platform and/or a drum) means without causing movement that would alter the accuracy of a weight measurement of a drum being weighed.

Figure 4:
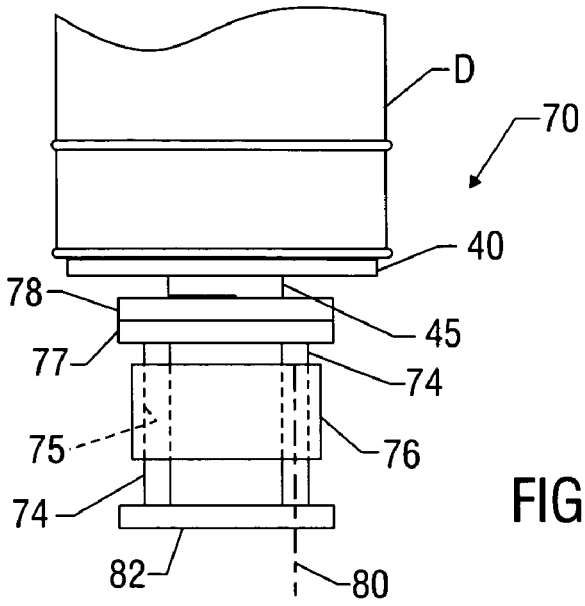
FIG. 4 is an isolated side view of an embodiment of a drum lifting device in accordance with the present invention.

Referring now to FIG. 4, an exemplary lifting device 70 in accordance with the present invention is shown. The lifting device 70 includes multiple simultaneously movable guide rods 74 capable of moving the drum weighing platform 40 precisely, or nearly precisely, vertically upwardly. As used in this patent, the term "drum" means any type of container (e.g. metal drums, wooden barrels, plastic containers) that can hold contents and be weighed. The illustrated lifting device 70 may be used in the example automatic drum handling and filling device described above and shown in FIGS. 1–3, or any other drum processing or handling system as desired. Accordingly, the present invention is not limited based upon the type of drum or container being lifted and weighed or the type of machine or system with which the present invention may be used or incorporated.

The lifting device 70 of the particular embodiment of FIG. 4 includes two guide rods 74 disposed within an actuator 76. Each illustrated guide rod 74 is a cylindrical, linear bearings having a circular cross-sectional shape (not shown) and is slidably moveable within a respective channel 75. The actuator 76 may, for example, be a commercially available pneumatic cylinder powered by a suitable power source (not shown). However, the present invention is not limited to this arrangement; there may be three or more guide rods 74 of any desired shape and configuration disposed within or actuated by one or more hydraulic cylinder (not shown) or any other suitable device powered in any desired manner and capable of moving the guide rods 74 up and down.

Still referring to the particular embodiment of FIG. 4, the guide rods 74 engage an upper stabilizer 77 at their upper ends and a lower stabilizer 82 at their lower ends. The stabilizers 77, 82 assist in encouraging the concurrent, or synchronized, upward vertical movement of the guide rods 74. In this example, the upper and lower stabilizers 77, 82 are plates constructed of steel and are connected with the guide rods 74. The upper stabilizer 77 is also connected to the platform 40. In the illustrated example, the upper stabilizer 77 engages a mounting plate 78, which sandwiches the weighing device 45 with the platform 40. The exemplary mounting plate 78 is a steel plate which assists in providing stability to the weighing device 45 and encouraging concurrent movement of the guide rods 74. However, the stabilizers 77, 82 and mounting plate 78 may have any other suitable form, configuration, construction and connection arrangement.

Figure 6:
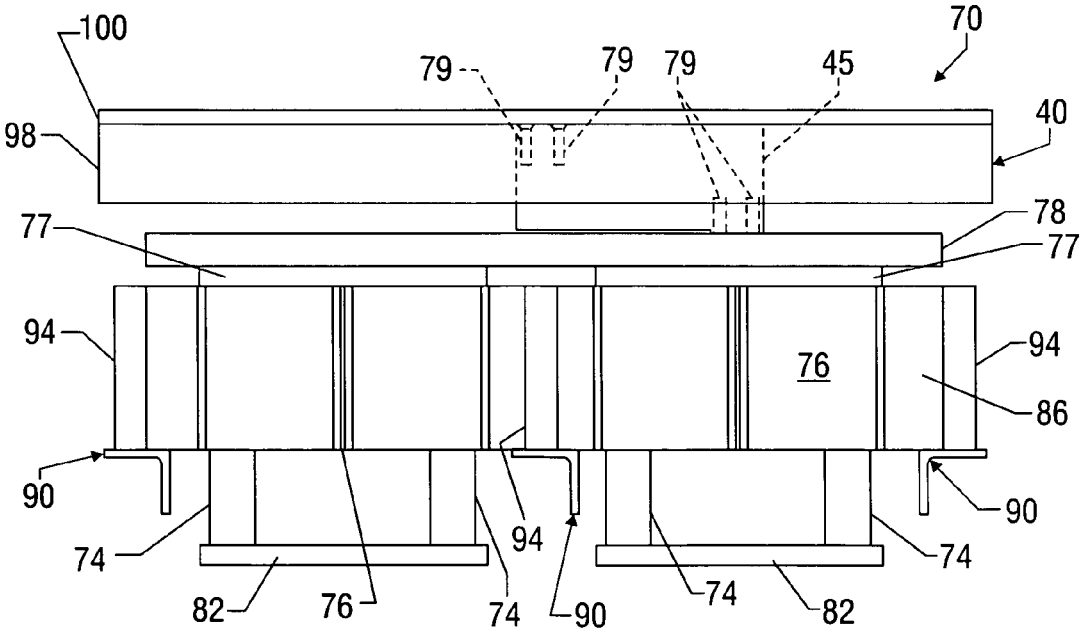
FIG. 6 is a side view of the embodiment shown in FIG. 5.

In the illustrated example, the weighing device 45 is a commercially available load cell connected to the mounting plate 78 and platform 40 with multiple bolts in each instance (see e.g. bolts 79, FIG. 6). However, the weighing device 45 but may be any other suitable device(s), and any other suitable connection mechanism(s) may be used.

In operation of the embodiment of FIG. 4, as the guide rods 74 are actuated to move upwardly in their respective channels 75, their upward movement is synchronized for precise, or nearly precise, vertical movement of the upper stabilizer 77, mounting plate 78, weighing device 45 and platform 40. Under normal operating conditions, the platform 40 is prevented from torquing, wobbling, side-to-side movement, shifting or rotating transverse to the longitudinal axis 80 of either guide rod 74.

Figure 7:
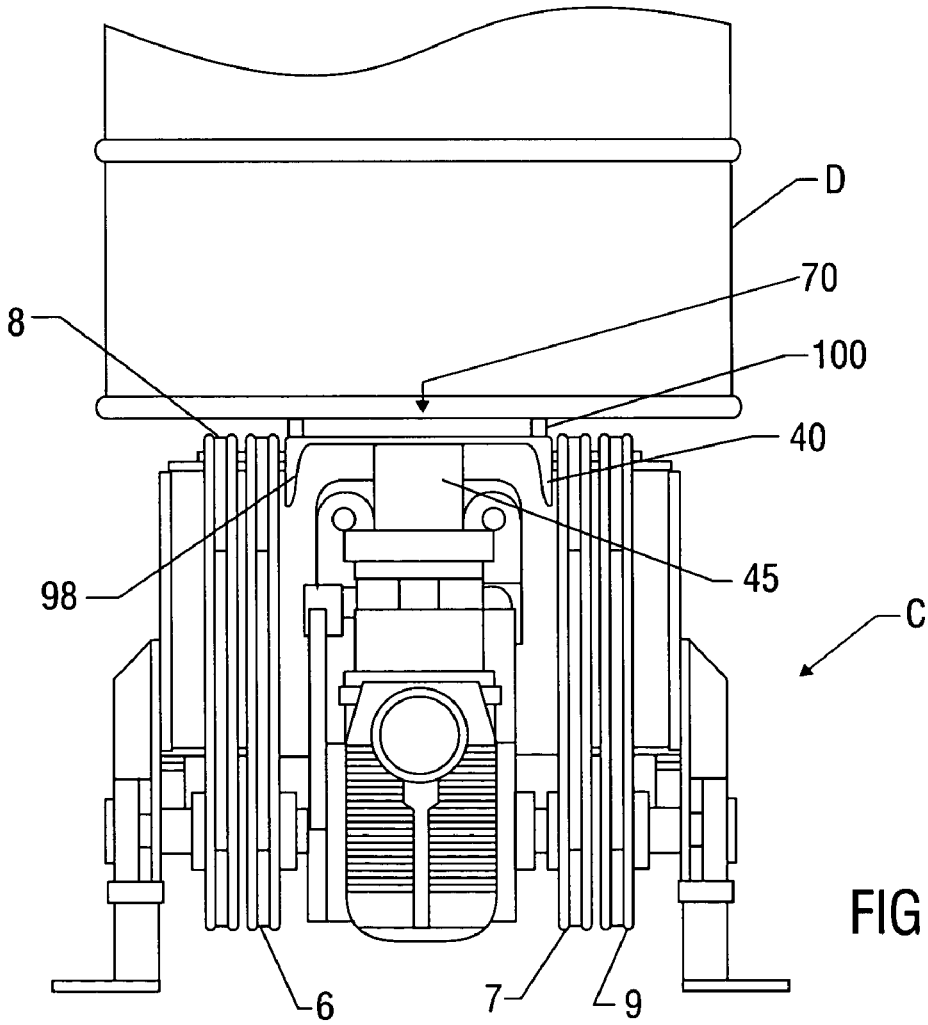
FIG. 7 is an end view of a drum conveyor apparatus including an embodiment of a drum lifting device in accordance with the present invention.
Figure 5:
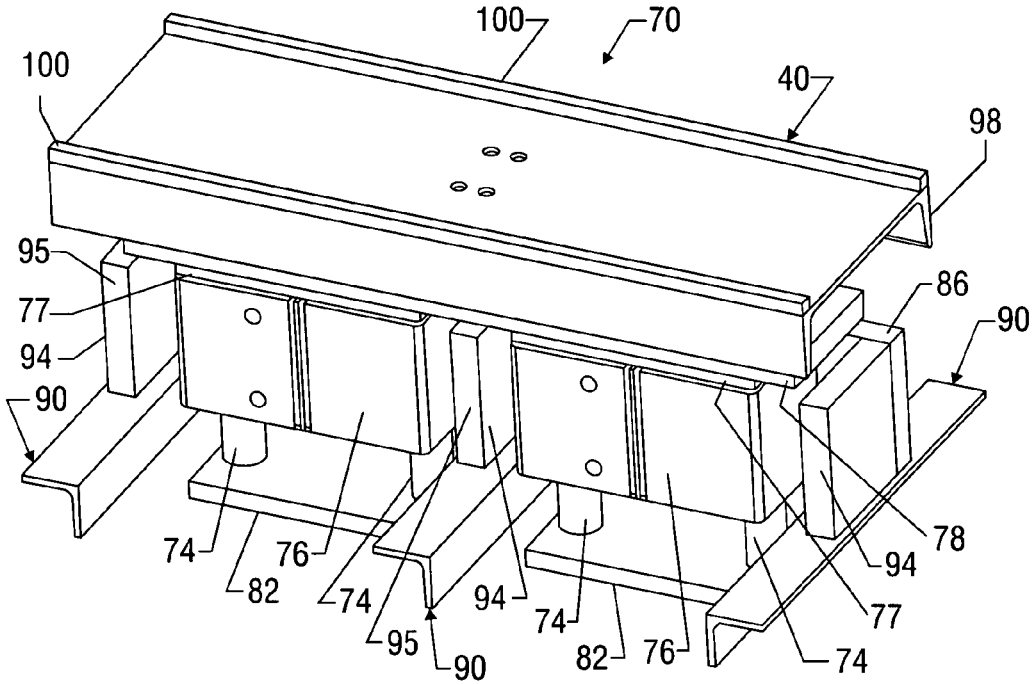
FIG. 5 is a perspective view of another embodiment of a drum lifting device in accordance with the present invention.

Another embodiment of a lifting device 70 in accordance with the present invention is shown in FIGS. 5–7. Except for particular differences noted below and otherwise as will become apparent to a person of ordinary skill in the art based upon this patent, the description and operation of the embodiment of FIG. 4 above applies similarly to this embodiment. Referring to FIGS. 5 and 6, the lifting device 70 includes four synchronized guide rods 74. Two guide rods 74 are each disposed within a respective actuator 76. Each pair of guide rods 74 engages a respective corresponding upper stabilizer 77 and lower stabilizer 82. The upper stabilizers 77 are both attached to a single mounting plate 78, which engages the weighing device 45 (FIG. 6). All four guide rods 74 are effectively tied together for concurrent, or synchronized, upward vertical movement.

Referring specifically to FIG. 5, the particular platform 40 shown is a channel member 98 having a lip 100 extending along each top edge thereof. Each lip 100 is a square rod, such as key stock, welded to the channel member 98. Thus, in this embodiment, there will be four points of contact between a drum and the platform 40 to assist in drum stability. However, the platform 40 is not limited to this configuration, but may take any suitable form, configuration and construction.

Referring now to FIGS. 5 and 7, the actuators 76 of this example are mounted to a common anchored support plate 86. Thus, the actuators 76 are stationary. In this embodiment, the support plate 86 is mounted to a frame 90, which is connectable to the overall conveyor system (not shown) or other apparatus. For example, the frame 90 may be connected to channel members (e.g. members, 1, 2 of FIG. 1) of the conveyor system (not shown) to assist in supporting and positioning the lifting device 70.

Referring back to FIGS. 5 and 6, if desired, one or more gusset 94 may be included, such as to assist in stabilizing and maintaining the upright position of the support plate 86, and/or centering the actuators 76 in the conveyor system (such as between the chains 6–9, FIG. 7). In the example shown, a gusset 94 is shown attached to and extending from the support plate 86 on each side of each actuator 76. The illustrated gussets 94 are also attached to the frame 90. For example, on its front side 95, each gusset 94 may be attached to part of the frame (not shown), channel members, another support plate (not shown) or other structure. The illustrated support plate 86 and gussets 94 are metal plates, but may take any suitable form and configuration, when included.

Referring to FIGS. 5 and 7, in operation of the illustrated embodiment, the lifting device 70 can be designed to precisely lift a drum and its contents of any desired weight, such as up to 1,000 pounds. After the drum D is positioned over the platform 40, the guide rods 74 are actuated to move upwardly in the respective actuators 76, pushing the upper stabilizer 77, mounting plate 78, weighing device 45 and platform 40 precisely upwardly. FIG. 7 shows the drum D lifted off of the chains 6, 7, 8 and 9. The weighing device 45 may then be actuated to weigh the drum D. If the lifting device 70 is used with a drum filling machine, such as the example of FIG. 1, a drum filling lance may be inserted into the bunghole of the drum while the drum is raised by the lifting device 70, and the drum may be weighed whenever desired. To lower the drum D, the guide rods 74 are actuated to move downwardly, lowering the platform 40 as desired, such as until the drum D again rests upon the chains 6, 7, 8 and 9 (FIG. 7).

Preferred embodiments of the present invention thus offer advantages over the prior art and are well adapted to carry out one or more of the objects of the invention. It should be understood that all of the above components and any other components that may be included may have any suitable, desired size, material construction, configuration, form and quantity, as is or becomes known. The present invention is in no way limited to the components, configurations, dimensions, specific examples or other details described above or shown in the attached figures. Further, the above-described features are not limited to the details as described and shown. Yet further, each such feature can be used independent of any other feature. Moreover, the present invention does not require each of the above features and includes further capabilities, functions, methods, uses and applications, as will be apparent to a person skilled in the art based upon the description above and the appended drawings and claims.

While preferred embodiments of this invention have been shown and described, many variations, modifications and/or changes, such as in the components, details of construction and operation, arrangement and connections of parts and/or methods of use, are possible, contemplated by the patentee, within the scope of the appended claims, and may be made and used by one of ordinary skill in the art without departing from the spirit or teachings of the invention and scope of appended claims. Thus, all matter herein set forth or shown in the accompanying drawings should be interpreted as illustrative and not limiting. Accordingly, the scope of the invention and the appended claims is not limited to the embodiments described and shown herein.

The invention claimed is:

1. A drum lifting apparatus useful in connection with a drum weighing device and capable of lifting a drum to enable the drum and its contents to be accurately weighed by the drum weighing device, the drum lifting apparatus including:

a drum weighing platform engageable with the drum and capable of supporting the drum;

at least two guide rods associated with said drum weighing platform, said at least two guide rods each having an upper end and a lower end and being movable upwardly in unison to move said drum weighing platform precisely upwardly;

at least one upper stabilizer rigidly engaged with at least two of said guide rods proximate to the upper end of each said guide rod; and at least one lower stabilizer rigidly engaged with at least two of said guide rods proximate to the lower end of each said guide rod, said upper and lower stabilizers assisting in synchronizing the upward movement of said at least two guide rods, whereby the drum supported and lifted on said drum weighing platform may be accurately weighed.

2. The drum lifting apparatus of claim 1, further including a mounting plate engageable between said at least one upper stabilizer and the weighing device.

3. The drum lifting apparatus of claim 2, wherein said drum weighing platform includes first and second lips upon which the drum rests, whereby the drum resting on said drum weighing platform has four points of contact with said drum weighing platform.

4. The drum lifting apparatus of claim 2, wherein at least two of said guide rods are disposed within at least one cylinder and wherein the weighing device is a load cell.

5. The drum lifting apparatus of claim 4, wherein each of said at least two guide rods is a linear bearing having a circular cross-section.

6. The drum lifting apparatus of claim 5, wherein said at least one cylinder is a pneumatic cylinder.

7. The drum lifting apparatus of claim 1, wherein said at least two guide rods includes first and second pairs of guide rods, said first pair of guide rods being connected to a first upper stabilizer, said second pair of guide rods being connected to a second upper stabilizer.

8. The drum lifting apparatus of claim 7, wherein said first and second upper stabilizers are connected to a mounting plate, said mounting plate being engaged between said first and second upper stabilizers and said drum weighing platform.

9. The drum lifting apparatus of claim 7, wherein the drum lifting apparatus is useful in connection with a drum conveyor system, wherein said first pair of guide rods is disposed within a first cylinder and said second pair of guide rods is disposed within a second cylinder, further wherein said first and second cylinders are engageable with a support plate, said support plate being engageable with the drum conveyor system.

10. The drum lifting apparatus of claim 9, further including at least one gusset connected with said support plate and capable of assisting in maintaining the upright position of said support plate.

11. The drum lifting apparatus of claim 10, wherein said drum weighing platform and said at least two guide rods are capable of supporting a drum weighing up to approximately 1,000 lbs.

12. The drum lifting apparatus of claim 1, wherein the drum lifting apparatus is useful in connection with a drum filling apparatus, the drum filling apparatus having an elongated lance disposable within the drum for filling the drum, wherein the position of said elongated lance within the drum may be maintained during lifting and weighing of the drum.

13. A drum lifting apparatus useful in connection with a drum weighing device and capable of lifting a drum to enable the drum and its contents to be accurately weighed by the drum weighing device, the drum lifting apparatus including:

a drum weighing platform engageable with the drum and capable of supporting the drum;

at least four guide rods associated with said drum weighing platform, said at least four guide rods each having an upper end and a lower end and being capable of being moved upwardly in unison to move said drum weighing platform precisely vertically upwardly; and a mounting plate engaged between said at least four guide rods and said drum weighing platform, said mounting plate assisting in synchronizing the upward movement of said at least four guide rods.

14. The drum lifting apparatus of claim 13, further including first and second upper stabilizers, said first upper stabilizer engaged between said mounting plate and two of said guide rods and said second upper stabilizer engaged between said mounting plate and another two of said guide rods.

15. An apparatus for processing at least one drum, the apparatus including:

a drum rotating device capable of rotating a drum around a vertical axis, said drum rotating device including at least two spaced idler wheels engageable with the outer surface of the drum and a power-operated drive wheel engageable with the outer surface of the drum generally opposite to said at least two spaced idler wheels;

a drum weighing device; and a drum lifting apparatus capable of lifting a drum to enable the drum and its contents to be accurately weighed by said drum weighing device, said drum lifting apparatus including a drum weighing platform and at least two guide rods associated with said drum weighing platform, said drum weighing platform being engageable with the drum and capable of supporting the drum, said at least two guide rods being movable upwardly in unison to move said drum weighing platform vertically upwardly.

16. An apparatus for processing at least one drum, the apparatus including:

a drum rotating platform upon which a drum may be held upright and rotated;

a plurality of rollers associated with said drum rotating platform, the axis of each of said rollers being oriented generally radially relative to the vertical axis of a drum disposed upon said drum rotating platform;

a drum weighing device; and a drum lifting apparatus capable of lifting a drum to enable the drum and its contents to be accurately weighed by said drum weighing device, said drum lifting apparatus including a drum weighing platform and at least two guide rods associated with said drum weighing platform, said drum weighing platform being engageable with the drum and capable of supporting the drum, said at least two guide rods being movable upwardly in unison to move said drum weighing platform vertically upwardly.

17. The apparatus of claim 16, further including a drum rotating device capable of rotating a drum around a vertical axis, said drum rotating device including a pair of spaced idler wheels engageable with the outer surface of the drum and a power-operated drive wheel engageable with the outer surface of the drum opposite to said pair of spaced idler wheels.

18. An apparatus for processing at least one drum, the drum having a bunghole formed in its top surface, the apparatus including:

a drum rotating platform upon which a drum may be held upright and rotated;

an electronic bunghole sensor capable of sensing the bunghole when the drum is rotated upon said drum rotating platform;

a drum weighing device; and a drum lifting apparatus capable of lifting a drum to enable the drum and its contents to be accurately weighed by said drum weighing device, said drum lifting apparatus including a drum weighing platform and at least two guide rods associated with said drum weighing platform, said drum weighing platform being engageable with the drum and capable of supporting the drum, said at least two guide rods being movable upwardly in unison to move said drum weighing platform vertically upwardly.

19. The apparatus of claim 18, further including a drum rotating device capable of rotating a drum around a vertical axis, said drum rotating device including at least two spaced idler wheels and a power-operated drive wheel engageable with the outer surface of the drum.

20. The apparatus of claim 19, further including a plurality of rollers associated with said drum rotating platform, said rollers being capable of allowing rotation of a drum disposed upon said drum rotating platform.

* * * * *